US009746143B2

(12) United States Patent
Osburn

(10) Patent No.: US 9,746,143 B2
(45) Date of Patent: Aug. 29, 2017

(54) LED UTILITY LIGHT

(71) Applicant: Paul Osburn, Holland, MI (US)

(72) Inventor: Paul Osburn, Holland, MI (US)

(73) Assignee: TFL Lighting Inc., Allegan, MI (US)

( * ) Notice: Subject to any disclaimer, the term of this patent is extended or adjusted under 35 U.S.C. 154(b) by 458 days.

(21) Appl. No.: 14/332,588

(22) Filed: Jul. 16, 2014

(65) Prior Publication Data

US 2016/0018072 A1 Jan. 21, 2016

(51) Int. Cl.

| | |
|---|---|
| ***F21L 14/02*** | (2006.01) |
| ***F21V 19/00*** | (2006.01) |
| ***F21K 9/232*** | (2016.01) |
| *F21Y 105/10* | (2016.01) |
| *F21Y 115/10* | (2016.01) |

(52) U.S. Cl.

CPC ..... *F21L 14/02* (2013.01); *F21K 9/232* (2016.08); *F21V 19/003* (2013.01); *F21V 19/0025* (2013.01); *F21Y 2105/10* (2016.08); *F21Y 2115/10* (2016.08)

(58) Field of Classification Search

CPC ..... F21L 14/02; F21K 9/232; F21Y 2101/00; F21Y 2115/10; F21Y 2105/10; F21V 19/003; F21V 19/0025

See application file for complete search history.

(56) References Cited

U.S. PATENT DOCUMENTS

| | | | | |
|---|---|---|---|---|
| 6,621,222 | B1 * | 9/2003 | Hong | F21V 3/02 315/272 |
| 6,787,999 | B2 | 9/2004 | Stimac et al. | |
| 7,549,773 | B2 | 6/2009 | Lim | |
| 7,553,051 | B2 | 6/2009 | Brass et al. | |
| 7,717,586 | B2 | 5/2010 | Tucker | |
| 7,887,331 | B1 | 2/2011 | Lin | |
| 8,033,681 | B2 | 10/2011 | Brass et al. | |
| 8,246,202 | B2 | 8/2012 | Mart et al. | |
| 8,353,611 | B2 | 1/2013 | Truesdale et al. | |
| 8,562,184 | B2 | 10/2013 | Klipstein et al. | |

* cited by examiner

*Primary Examiner* — Stephen F Husar

(74) *Attorney, Agent, or Firm* — Black, McCuskey, Souers & Arbaugh, LPA

(57) ABSTRACT

An LED utility light has a one or more LED devices supported by a mounting structure and electrically connected to a mounting base section and to a boss and base cap for electrical engagement with a receptacle. LED device circuitry and conductive leads are located in the mounting structure and the mounting base section. A housing substantially surrounds the mounting structure.

6 Claims, 7 Drawing Sheets

LED UTILITY LIGHT

RELATED APPLICATIONS

This application has no related applications.

FIELD OF THE DISCLOSURE

The present disclosure and related inventions is in the general field of lighting devices.

BACKGROUND

Portable and handheld lighting devices, AC and DC powered and with different types of illumination sources, are made in many different configurations and sizes. The development of low-cost electroluminescent light-emitting diodes (LEDs) has led to extensive use of this technology in a wide variety of lighting applications and illumination devices. Due to the very high refractive index of uncoated LED semiconductors, for lighting applications LED chips are mounted or encapsulated in plastic as a refractive intermediary to maximize photon emission. Also, the geometry of the chip surfaces can be designed with facets to minimize internal reflection, expand the emitted cone of light, and thereby increase luminous efficacy. Although encapsulated, LED arrays for non-static applications require additional packaging for additional protection, and optical elements which enhance and do not diminish or adversely affect the output lumens.

SUMMARY OF THE DISCLOSURE

The present disclosure and related invention provide an LED utility light with exceptionally high light output and structural strength and durability. In a preferred embodiment, an LED utility light of the disclosure includes the principal combined components of an LED mounting structure which includes a base for connection to a power socket, and a housing which surrounds the mounting structure. In certain embodiments the LED mounting structure has at least one planar portion on which individual LEDs are mounted in various patterns. Conductive leads to the LEDs are contained in the mounting structure and extend from the LEDs to the base of the mounting structure. In a preferred embodiment, the base of the mounting structure is configured for engagement with a screw-in type lamp receptacle.

In accordance with one aspect of the disclosure and related inventions, there is provided a light which includes a mounting structure with a first surface, a second surface spaced from the first surface, and a perimeter which extends between the first surface and the second surface, a mounting base structure which extends from the first surface and the second surface and the perimeter, and a boss which extends from the mounting base structure; one or more LED devices attached to the mounting structure and at least one conductive lead in the mounting structure, the conductive lead electrically connected to the one or more LED devices and extending to the mounting base structure, a base cap attached to the boss and in conductive contact with the conductive lead, and a housing substantially surrounding the mounting structure, the housing having at least one transparent part.

In accordance with another aspect of the disclosure and related inventions, a light has a mounting structure having a first surface, a second surface spaced from the first surface, and a perimeter which extends between the first surface and the second surface; one or more LED devices attached to the mounting structure and at least one conductive lead in the mounting structure, the conductive lead electrically connected to the one or more LED devices and extending through the mounting structure; a mounting base section which extends from the mounting structure, a boss which extends from the mounting base section, and a base cap connected to the boss, the base cap in electrically conductive contact with the conductive lead in the mounting structure, the boss and base cap configured to be received in a lamp receptacle. In certain embodiments, a housing substantially surrounds the mounting structure and the mounting base section and the boss extends through an opening in the housing for threaded engagement with a receptacle.

These and other aspects of the present disclosure and related inventions are further described herein with reference to the accompanying Drawings.

DETAILED DESCRIPTION OF PREFERRED AND ALTERNATE EMBODIMENTS

Figure 1:
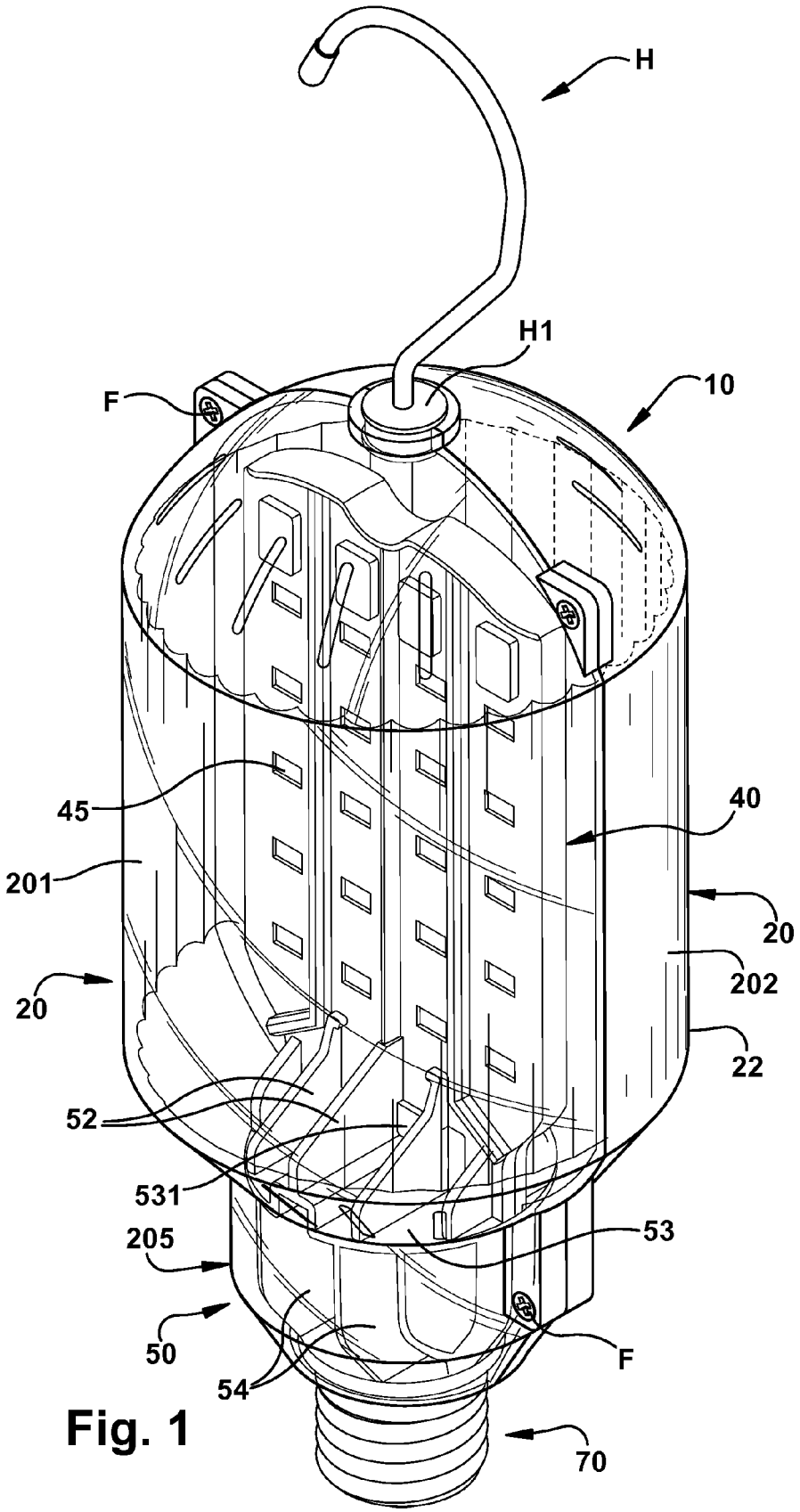
FIG. 1 is a perspective view of a first embodiment of an LED utility light of the present disclosure.
Figure 1A:
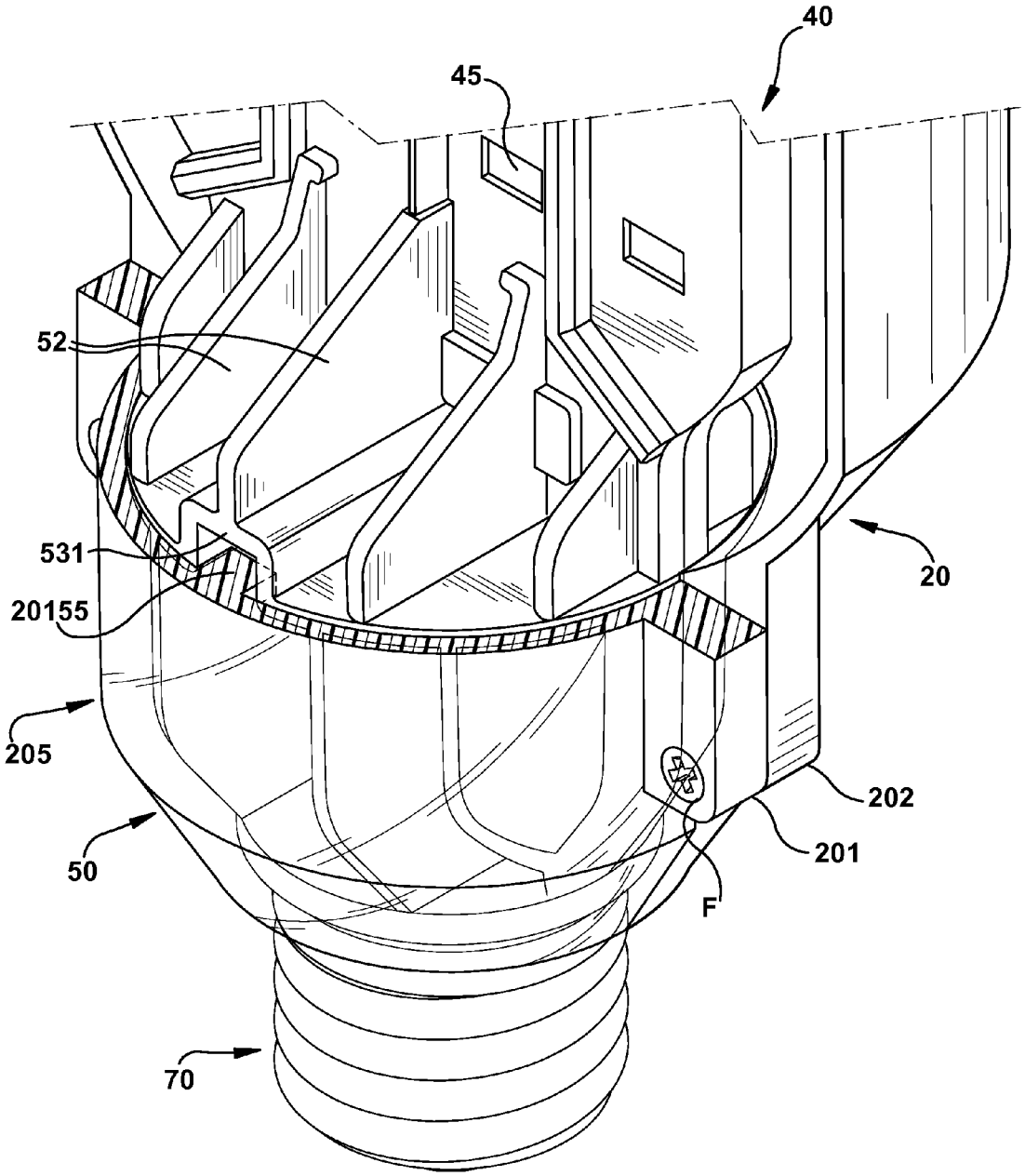
FIG. 1A is a perspective view of a base portion of the LED utility light of the present disclosure.
Figures 2, 2A, 2B:
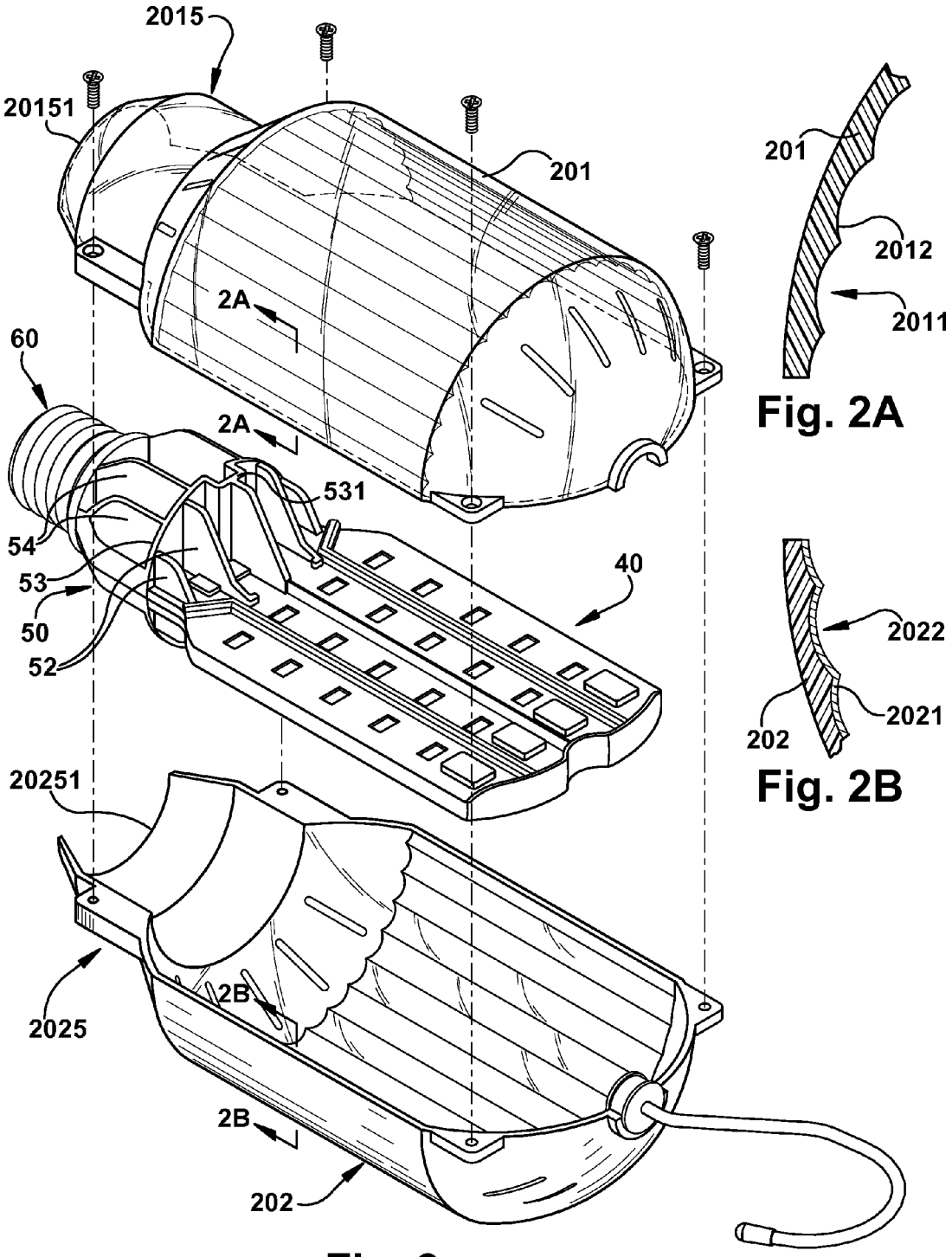
FIG. 2 is a perspective assembly view of a housing component of the LED Utility Light of FIG. 1.
FIG. 2A is a cross-sectional view of a portion as indicated of a housing of the LED Utility Light of FIG. 2.
FIG. 2B is a cross-sectional view of a portion as indicated of a housing of the LED Utility Light of FIG. 2.

As shown in the drawing Figures, and with initial reference to FIGS. 1 and 2, an LED utility light, indicated generally at 10, includes an LED mounting structure 40 having generally planar sides 401, 402 in which one or more LEDs are mounted. The mounting structure 40 is substantially surrounded by a transparent or semi-transparent housing indicated generally at 20. As further described, the mounting structure also includes a mounting base structure 50, which further includes vertical webs 52 and 54, horizontal webs 53 and 531, and extends to a boss 60 with a threaded profile 62 to form a threaded base 70 configured for engagement with a receptacle such as a conventional 110V/220V sourced AC socket, as further described. The mounting structure 40 has a lower section 48 which extends through the mounting base structure 50 as illustrated and has an interior cavity for passage of one or more electrical leads from the base 70 to the LEDs in the mounting structure 40. In one embodiment, the housing 20 is formed in cooperating halves 201, 202 and attached about the mounting structure 40 and the mounting base structure 50 and forming an opening through which the base 70 extends. The base 70 in this particular embodiment is in the form of a threaded base with male threads configured for threaded engagement with an electrical power receptacle. However, the LED utility light of the present disclosure can be configured to fit and work with other types of electrical receptacles, connectors and power sources.

In the embodiment illustrated in FIGS. 1-5 and 11, the housing 20 is generally cylindrical as defined by an outer wall 22, and formed by the assembly of cooperating parts or halves, 201 and 202. Preferably one part, such as for example part 202 has a reflective surface, coating, device or material or layer (collectively "reflective surface") 2021 on a generally concave curved plane interior side thereof. The reflective surface 2021 can be, for example, a highly reflective material such as plated ABS or other material, metallic or non-metallic. A layer of reflective material 2021 is indicated in FIG. 2B. In the illustrated embodiment, the reflective surface 2021 has a non-planar surface configuration, for example in the form of a series of troughs or ridges, or projections or undulations, indicated generally at 2022, which provide additional reflective surface area with a radial reflective array by which each trough 2022 reflects light in multiple directions from the reflective surface 2021. The reflective vectors may be lateral with respect to a longitudinal axis of the housing 20 or along a length of the housing, or a combination thereof. The cooperating part 201 is preferably substantially transparent, such as clear plastic such as ABS to serve as a light path or lens of the housing 20. An interior surface of part 201 can be configured with one or more optical features to define or augment refraction, focusing or field of illumination from the light sources within the housing 20. For example and as illustrated in FIG. 2A, the interior surface 2011 of part 201 may have a series of radiused columns 2012 oriented along a length of the housing 20. As indicated on FIG. 2, each part 201, 202 of the housing 20 has a corresponding housing base section 205 formed by 2015 and 2025 configured to fit over the mounting base section 50. Edges 20151 and 20251 when joined together form an opening through which the boss 60 (and base 70) extends. In the illustrated embodiment, parts 201, 202 form generally first and second halves of the housing 20, for example fastened together by fasteners F about the mounting structure 40 and about the mounting base structure 50, with the base 70 extending through an opening in the housing 20. In alternate embodiments, each part 201 or 202 may form generally more or less than half of the housing 20, by for example extending more or less than 180 degrees about the generally cylindrical circumference of the housing 20. There may be different points or areas of contact between the housing 20, the interior surfaces of parts 201 and 202, and the mounting structure 40 including the mounting base structure 50. A preferred area of contact between the housing 20 and the mounting structure 40 is between the housing base sections 2015 and 2025 and the mounting base structure 50, as further described.

An LED mounting structure, indicated generally at 40, is configured to fit within the interior space defined by the housing 20. In the illustrated preferred embodiment, the LED mounting structure 40 has generally planar surfaces 401 and 402 upon which or within which one or more LED devices 45 are mounted, as further described. Although illustrated in a flat planar configuration, the mounting structure 40 may have alternative configurations with some curvature to the planar surfaces 401, 402, such as for example curvature toward or away from the lens part 201, or even cup-shaped with a convex or concave surface facing the lens part 201.

Figure 6:
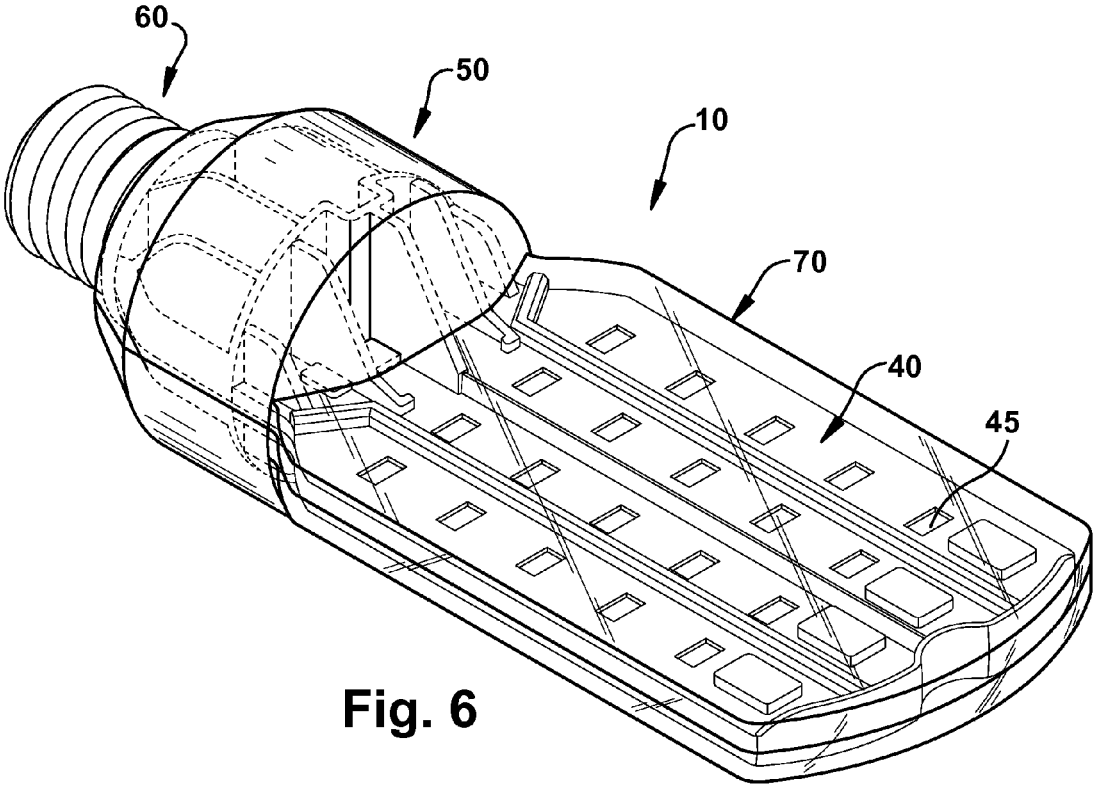
FIG. 6 is a perspective view of an alternate embodiment of an LED mount and base of the present disclosure.
Figure 7:
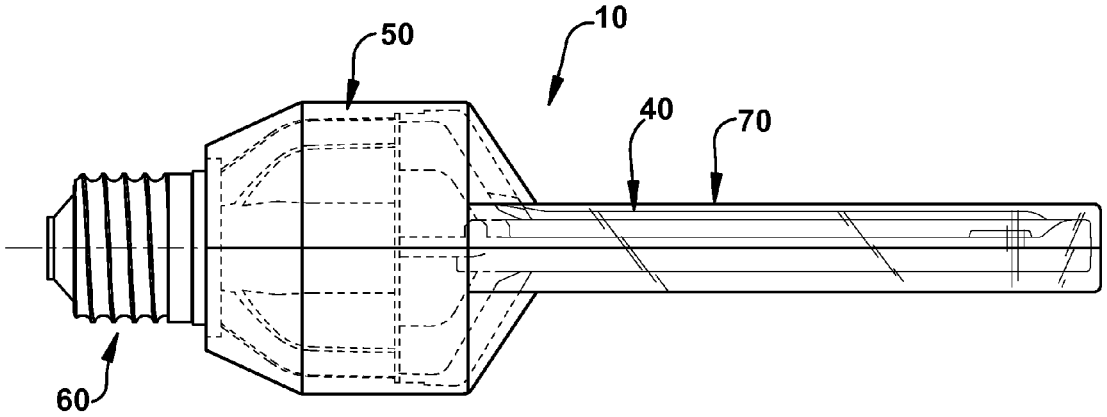
FIG. 7 is a profile view of the LED mount and base of FIG. 6.

The mounting structure 40 is formed to have a first side 401 and second side 402, joined by a perimeter wall 403, which provides the structure 40 with an interior volume within which the one or more LED devices 45, or LED device driver circuitry, can be mounted. Alternatively, the LED devices 45 may be mounted directly on the surfaces 401, 402. For example, some or all of the basic components of an LED as known in the art can be located, mounted on or formed integrally with the structure 40, including for example the LED anode, cathode, flat spot, lead frame (anvil/post) and wire bond, the semiconductor die and reflective surround or cavity or mount, and a lens or case or encapsulation such as epoxy encapsulation. Alternatively, a cover, lens or encapsulation layer can be applied over the LED devices 45 on to the surface of the mounting structure 40. FIGS. 6 and 7 illustrate an alternate embodiment of an LED utility light 10 of the disclosure with an alternate embodiment of a transparent or semi-transparent housing indicated at 70, which encompasses or fits over the mounting structure 40, and optionally over the base structure 50, as further described.

Figure 5:
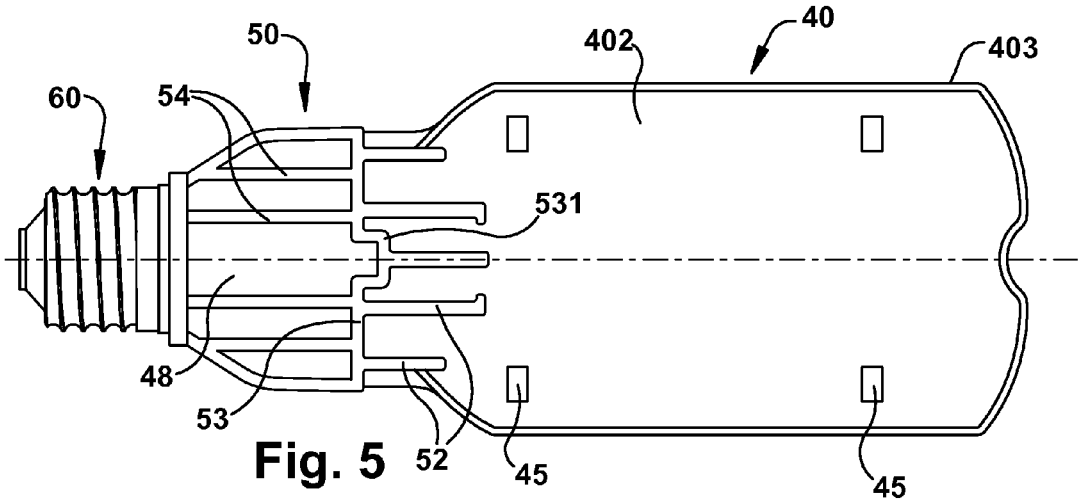
FIG. 5 is an opposite plan view of the LED mount and base of FIG. 4.

Also located within the mounting structure 40 are one or more conductive pathways to the one or more LED devices 45, in series or parallel. Each array of LED devices, whether arranged linearly or in a common area may have a common power conductor path, or be co-mounted on a circuit board which includes a power bus or leads. Driver circuitry for one or multiple LED devices 45 may be located proximate to each device or remote but within the mounting structure 40. As shown in FIG. 5, one or more LED devices 45 may also be provided on the opposing surface 402 of the mounting structure 40. As in the illustrated embodiment, there may be as many as twenty (20) or more LED devices on one or both of the surfaces 401, 402. Also, sub-groups of an array of LED devices 45 may be commonly located or arranged, such as in rows or columns as illustrated, and commonly electrically connected and/or mounted, such as for example on a common circuit board and/or power bus.

In the illustrated embodiment, the profile of the mounting structure, as defined by surfaces 401 and 402 and the perimeter wall 403, is dimensioned to fit within the interior space of the housing 20, for example with the perimeter wall 403 proximate to and spaced from the interior surface of the housing 20. Alternatively, the perimeter wall 403 could be dimensioned to fit substantially against or in contact with the interior surface of the housing 20. Accordingly, the mounting structure 40 can be used in combination with different housings of different sizes and shapes.

Figure 3:
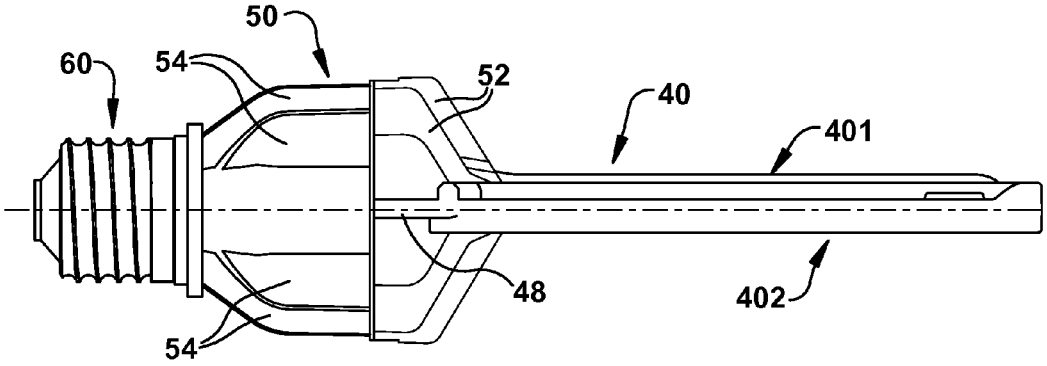
FIG. 3 is a profile view of an LED mount and base of the LED Utility Light of FIG. 1.
Figure 4:
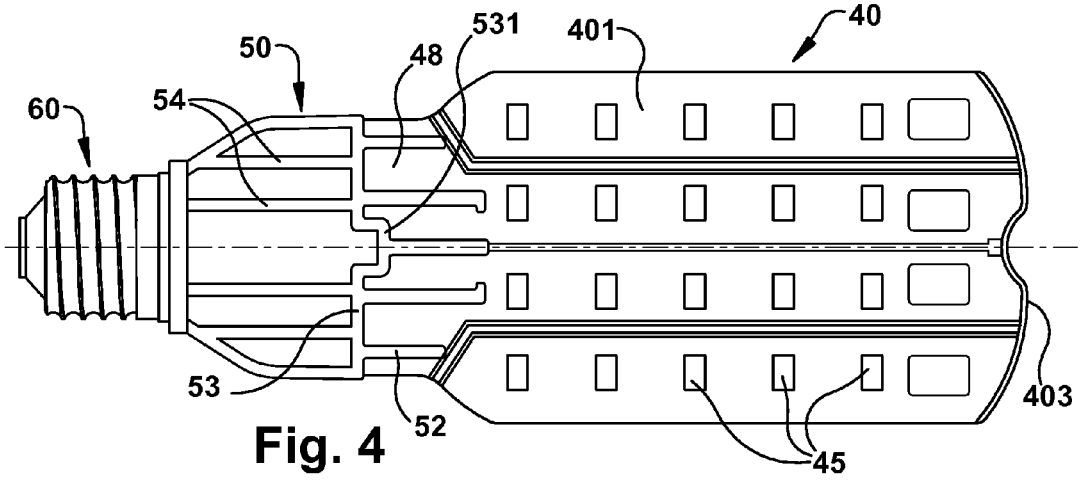
FIG. 4 is a plan view of the LED mount and base of FIG. 3.

As further shown in FIGS. 1-5, attached to or extending from or formed integrally with the mounting structure 40 is a mounting base section 48. As shown in FIGS. 3-5, the mounting base section 48 extends from the mounting structure 40 to the boss 60. The mounting base section 48 also has an internal volume in which is contained electrical leads to the LED devices 45 in the mounting structure 40. Also formed integrally with or otherwise attached to and extending from the mounting structure 40 is a base structure or mounting base structure, indicated generally 50. In the particular illustrated embodiment, the mounting base structure 50 extends from surfaces 401, 402 and perimeter wall 403, and generally away from surfaces 401, 402 and the array of LED devices 45, for example by an arrangement of webs or ribs 52 as illustrated. As noted, the mounting structure 40 further includes a lower section 48 which co-extends with the webs 52 in a direction away from surfaces 401, 402 and the LED devices 45 and extends to the boss 60. Electrical components, including circuitry and conductive paths or leads, with or without circuit boards, may be incorporated in the lower section 48. The mounting base structure 50 may further include, as illustrated, one or more transverse webs or ribs 53 (including central web 531) which extends generally transverse to webs 52 and generally across a width of the base structure 50. The base structure 50 as illustrated further includes additional webs 54, arranged generally parallel to webs 52, and which are tapered to a boss 60 which is in the form of a threaded socket base with projecting helical thread profiles 62. Profiles of the webs 54 are generally configured to fit within the housing base section 205, as formed by the interior surfaces of the cooperating halves 2015, 2025. In this area the housing base section 205 may or may not contact the mounting base structure 50. As illustrated, one or more contact points may be formed in the interior of the housing base section, such as key 20155, for contact with the mounting base structure 50, for example at central web 531 and/or elsewhere, whereby the housing 20 is in contact with the mounting structure 40 at one more points which holds the mounting structure 40 in position within the interior of the housing 20.

Figure 8:
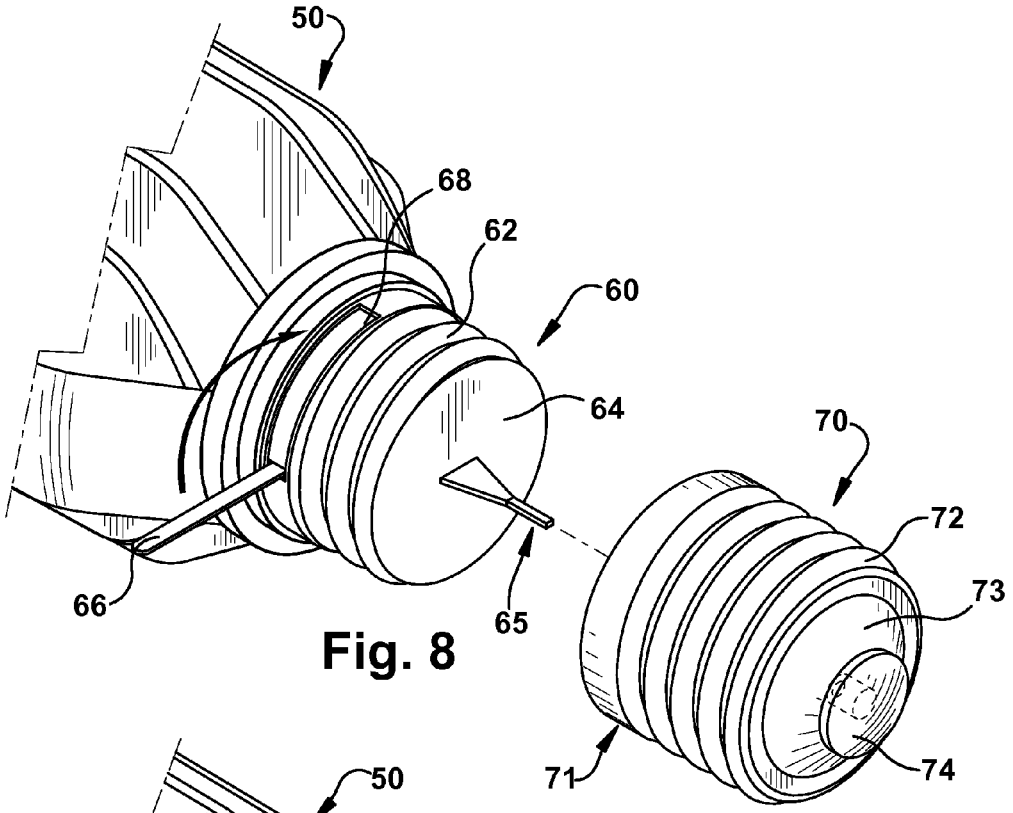
FIG. 8 is a perspective assembly view of a portion of a base of an LED mount and base of the present disclosure.
Figure 9:
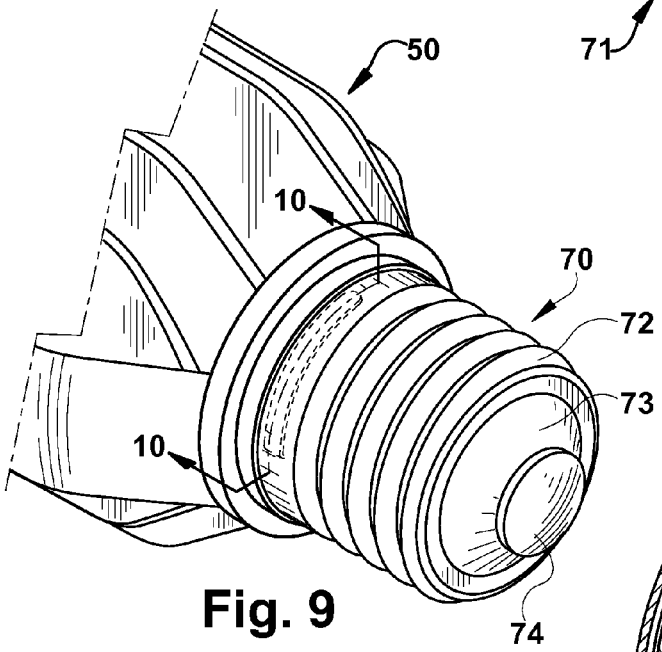
FIG. 9 is a perspective view of a portion of the LED mount and base of FIG. 8.
Figure 10:
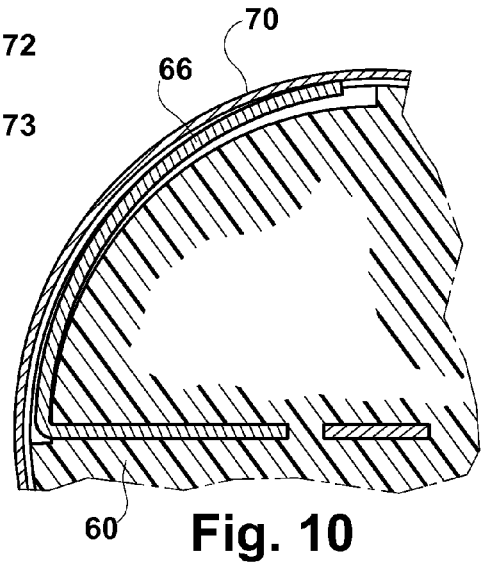
FIG. 10 is a cross-sectional view of a portion of the LED mount and base of FIG. 9.

As illustrated in FIGS. 8-10, the boss 60 is configured to receive by threaded engagement a base cap 70, which may be fabricated from aluminum or other material and which is preferably electrically conductive. The cap 70 includes a cylindrical body 71 with projecting threads 72 which fit with the thread profiles 62 of the boss 60, a base end 73 and a conductive contact 74 which protrudes from the base end 73. As shown in FIG. 8 a conductive electrical lead 65 extends through an end wall 64 of the boss 60. A second electrical contact lead 66 extends through the side wall or thread profiles 62 of the boss, for example through opening 68, and is formed to fit closely against the boss 60. The conductive leads 65 and 66 are electrically connected to LED device circuitry in the mounting structure 40 through the base section 48. Lead 66 as a conductor is flexible and/or formable, and after positioned through opening 62 in boss 60 is shaped to conform to the outer surface of the boss 60, as shown in FIGS. 9 and 10. The base cap 70 is then attached to the boss 60 by threaded engagement and in electrically conductive contact with the conductive leads 65 and 66.

Figure 11:
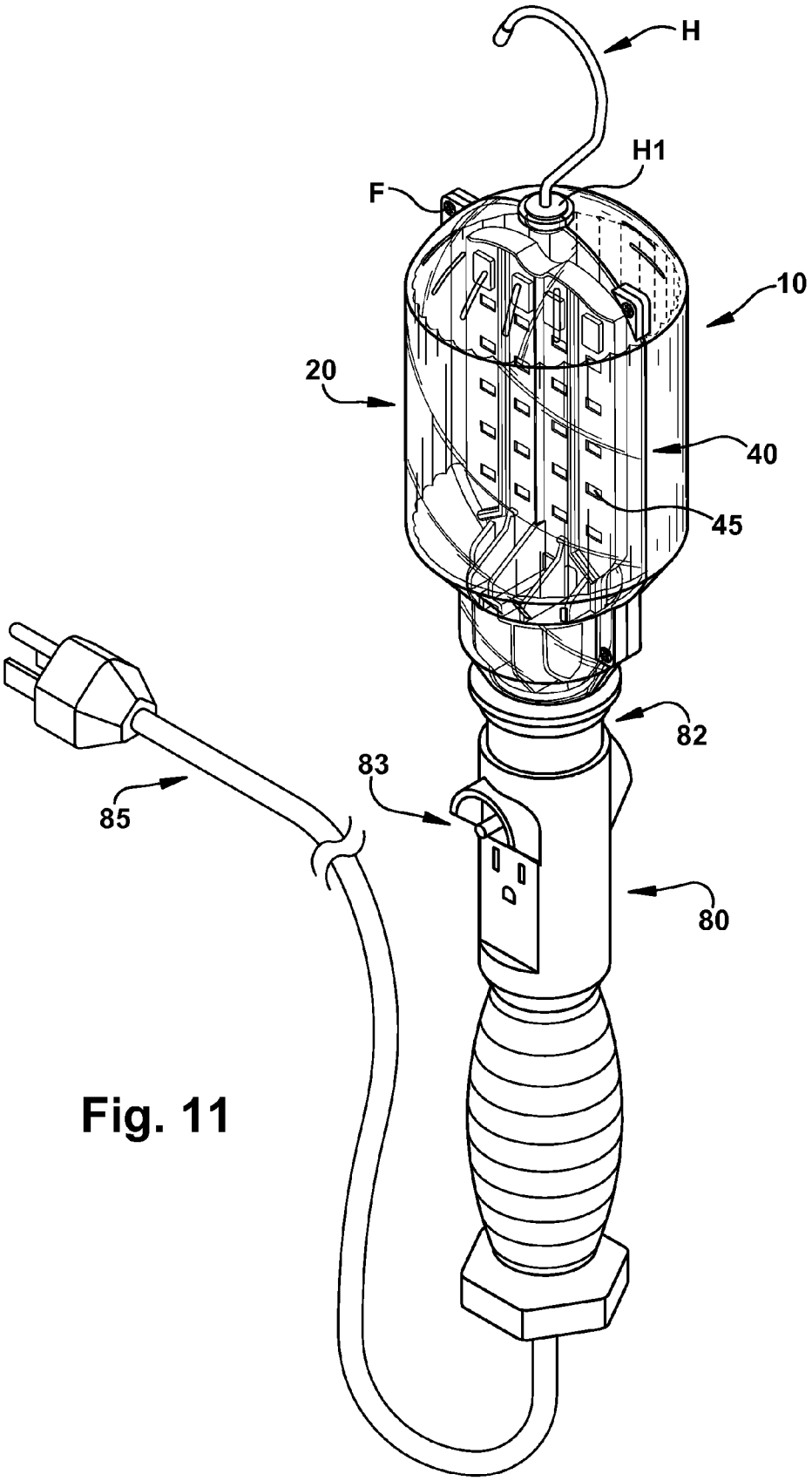
FIG. 11 is a perspective view of an LED utility light assembly of the present disclosure.

As illustrated in FIG. 2, the cooperating parts 201, 202 of the housing 20 are fastened together about the mounting structure 40 and base structure 50, for example by fasteners F, by snap connection integrally formed with the parts 201, 202, or by a bonding agent or adhesive. The LED Utility Light 10 is then securely assembled with the mounting structure 40 and LED devices 45 sealed and protected within the housing 20. A hanger H can be mechanically attached to the housing 20, for example by a pivot fitting H1. The base cap 70 can be installed by threaded engagement with any conventional female threaded lamp receptacle. For example, as shown in FIG. 11, for use as a utility or "trouble" light, the LED Utility Light 10 is engaged with a handheld fixture 80 which includes a receptacle 82 with integral switch 83, and if AC powered, a cord 85.

What is claimed as the invention is:

1. A light comprising:

a mounting structure, a plurality of light-emitting diodes (LEDs) attached to the mounting structure, a mounting base section attached to the mounting structure, a boss which extends from the mounting base section, an electrically conductive lead which extend from the boss to the mounting structure to conduct electricity to the plurality of LEDs, a base cap connected to the boss, the base cap in electrically conductive contact with the conductive lead, and a housing which substantially surrounds the mounting structure and is in contact with the mounting base section, the housing having an opening through which the boss extends wherein the housing comprises a transparent portion and a non-transparent portion.

2. The light of claim 1 wherein the boss and base cap are located outside of the housing.

3. The light of claim 1 wherein the non-transparent portion of the housing further comprises a reflective coating facing the mounting structure.

4. The light of claim 1, the plurality of LEDs are arranged in a generally rectangular array on a surface of the mounting structure.

5. The light of claim 1, wherein the housing is generally cylindrical.

6. The light of claim 1, in combination with a receptacle wherein the base cape is engaged with the receptacle and is in electrical contact with the receptacle.

* * * * *